United States Patent [19]

Haasis, Jr.

[11] 4,265,094

[45] May 5, 1981

[54] UNITIZED REFRIGERATION AND WATER HEATING SYSTEM

[76] Inventor: Hans Haasis, Jr., 1421 Duarte Cir., Simi Valley, Calif. 93065

[21] Appl. No.: 81,675

[22] Filed: Oct. 4, 1979

[51] Int. Cl.[3] ..... F25B 27/02; A28F 11/00

[52] U.S. Cl. ..... 62/238.6; 165/70; 165/163

[58] Field of Search ..... 62/238 E, 79, 175, 335; 237/2 B; 165/70, 163

[56] References Cited

U.S. PATENT DOCUMENTS

| | | | |
|---|---|---|---|
| 1,808,494 | 6/1931 | Carney et al. | 62/79 |
| 2,453,823 | 11/1948 | Williams | 62/79 |
| 2,698,524 | 1/1955 | Rygard | 62/335 X |
| 2,796,743 | 6/1957 | McFarlan | 62/335 |
| 2,797,068 | 6/1957 | McFarlan | 62/335 X |
| 4,041,724 | 8/1977 | Gustafsson | 62/175 |
| 4,104,890 | 8/1978 | Iwasaki | 62/335 X |
| 4,173,125 | 11/1979 | Bradshaw | 62/238 E |
| 4,176,525 | 12/1979 | Tucker et al. | 62/335 X |
| 4,199,955 | 4/1980 | Jonsson | 62/238 E |
| 4,216,821 | 8/1980 | Robin | 165/70 |

*Primary Examiner*—Lloyd L. King

*Attorney, Agent, or Firm*—Poms, Smith, Lande & Rose

[57] ABSTRACT

A special unitary heat exchange unit for safely heating potable water from the waste heat of a number of refrigeration units is formed of a large diameter pipe perhaps 4 to 10 inches in diameter and perhaps 6 to 20 feet in length to extend along a refrigeration rack. The water to be heated is passed through the length of the heat exchanger, which is essentially a cylindrical tank enclosing a number of small double walled coils each constituting a heat exchanger through which freon or other similar refrigeration gas is passed for cooling. The double walled coils include the inner tube which carries freon, and an intermediate buffer zone in which a non-poisonous heat transfer liquid is located. The outer metal tubing is sealed to the inner freon containing tubing immediately outside the heat exchanger with a low pressure seal so that any break in the high pressure freon line will cause the freon to escape into or to be vented into the atmosphere, and no contamination of the potable water being heated will occur.

16 Claims, 4 Drawing Figures

HOT WATER HEATER
PREHEAT STORAGE TANK
COLD WATER
P

UNITIZED REFRIGERATION AND WATER HEATING SYSTEM

FIELD OF THE INVENTION

This invention relates to improved and simplified refrigeration, air conditioning, and heat recovery systems in which the heat generated through refrigeration is employed to form potable hot water.

BACKGROUND OF THE INVENTION

Many systems have been proposed heretofore for using some portion of the heat generated during the refrigeration cycle to heat ambient air or hot water for washing dishes or the like. However, these units are often very inefficient and only recover some portion of the waste heat. In addition, there is a danger when potable water is heated from the freon or other poisonous refrigeration gas, that the potable water will be contaminated. To avoid this problem, some systems have provided an intermediate fluid, and a separate spaced heat exchanger to isolate the freon from the potable water. Unfortunately this has the effect of significantly increasing the complexity of the system, as well as introducing further heat losses and lowering the efficiency of the system. One system for recovering heat from a large number of refrigeration units is shown in U.S. Pat. No. 4,041,724, in which the complexity of the required manifolding arrangements and the like should be noted. While some specialized units using special castings and heat exchange structures have been proposed for heating water from more than one refrigeration unit, these units have been relatively costly, and still must face the problems of possible potable water contamination.

Accordingly, a principal object of the present invention is to provide a simplified, improved and more efficient system for utilizing the waste heat from a number of refrigeration units to heat potable hot water, while still protecting the water against contamination by refrigeration gases.

SUMMARY OF THE INVENTION

The system of the present invention involves a series of refrigeration units on the one hand, and a hot water requirement or hot water heater on the other hand, and has as its key component a heat exchanger in the form of a large cross-section standard pipe containing a series of double walled coils of standard configuration, with one coil being provided for each refrigeration unit. The freon or other refrigeration gas is routed through the center pipe of each of the double walled coils, and a potable heat transfer liquid is located within the space between the inner and outer tubes of the double walled coil to safely transfer heat from the high pressure refrigeration gas to the potable water which is passed through the heat exchange pipe. A low pressure seal between the inner and outer tubes forming the double walled tubing is located just outside the heat exchanger so that if the high pressure freon leaks, the seal will immediately be ruptured or will blow, thus preventing contamination of the potable water being heated.

The heat exchange unit as described above may be connected in series with a preheat storage tank, or may be connected directly to a hot water heater unit.

Advantages of the new system involve the following:

1. The inclusion of the functions of both manifolding and isolation of the potable water in a single structure.
2. The automatic inclusion of substantial water storage capacity within the heat exchanger.
3. Less back pressure is required in view of the large diameter of the heat exchange pipe, and less pumping and other electricity consuming functions are required.
4. No manifolding is required; therefore producing greatly simplified plumbing arrangements.
5. Any freon leak involves the mere release of the refrigeration gas into the atmosphere rather than contamination of the potable water.
6. A smaller water heater or boiler is required in view of the more complete heat absorption from the refrigeration units.
7. Assembly of insulation is limited to a single unit, and is thereby simplified.

Collateral subordinate features of the invention involve the use of a standard cylindrical pipe which may extend for substantially the full length of the refrigeration rack, and the use of different size coils in the unit commensurate with the refrigeration capacity of the different refrigeration units being accommodated.

Other objects, features, and advantages will become apparent from a consideration of the following detailed description and from the accompanying drawings.

BRIEF DESCRIPTION OF THE DRAWINGS

Referring more particularly to the drawings,

In FIG. 1, the refrigeration rack 12 includes a number of refrigeration units 21 through 27 of different sizes, a heat exchanger 14 forming a key part of the present invention, a pre-heat storage tank 16, and a boiler or hot water heater 18. Each of the refrigeration units 21 through 27 includes a refrigerant circuit 32 containing in series, an expansion valve 34, an evaporator 36, a compressor 38, a double walled condenser coil 40 within the heat exchanger 14, a second air-cooled condenser 42, and a reservoir 44. Incidentally, the portion of the unit 21 below dashed line 45 is remotely located at the air conditioning unit or refrigerator box where the cooling is to take place.

Figures 1, 3:
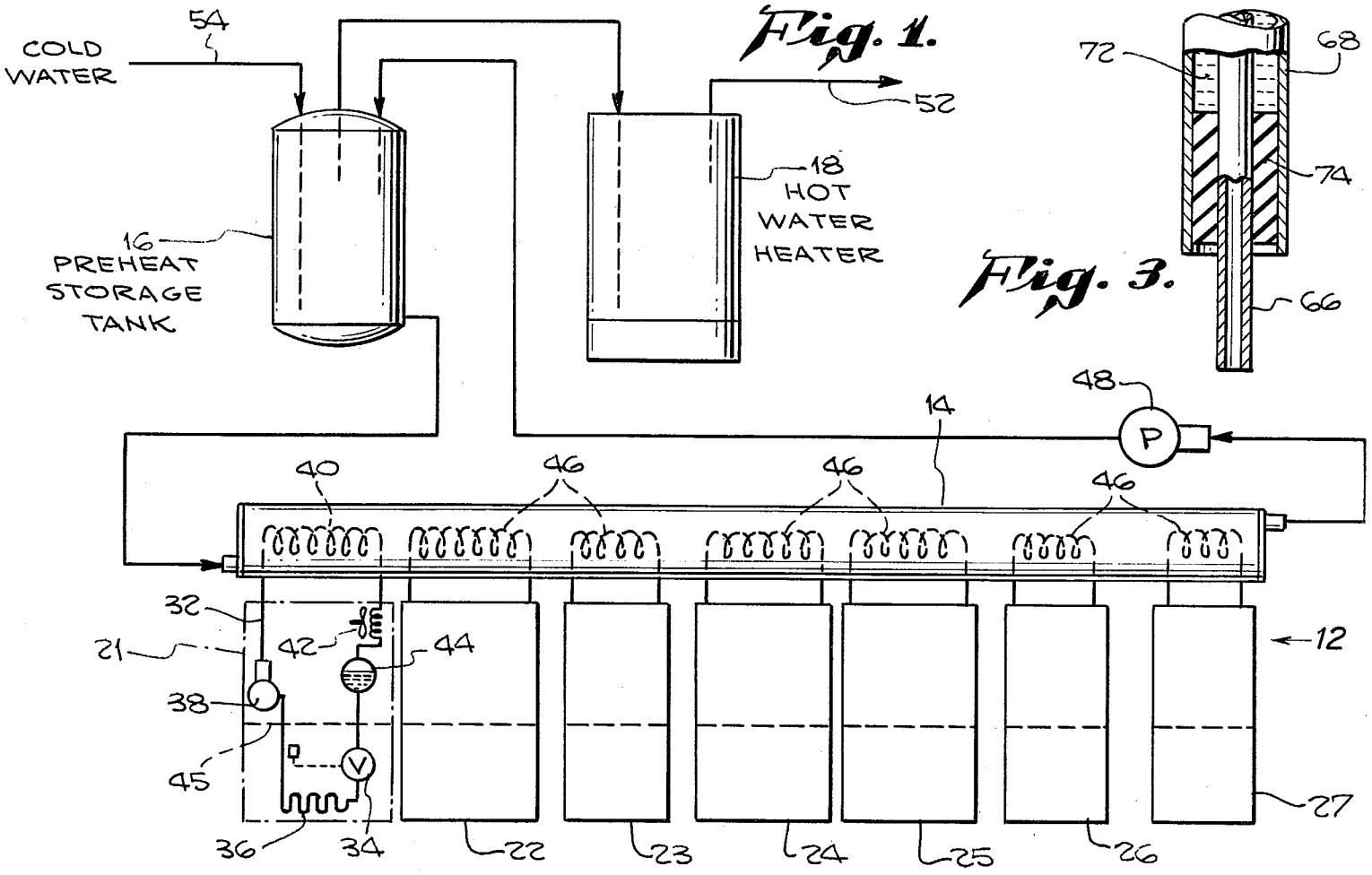
FIG. 1 is a schematic showing of an installation for providing a number of refrigeration and air conditioning functions for a facility, such as a large restaurant, and also shows arrangements for recovering the waste heat created in the refrigeration process through heating hot water, which is of course also needed for dishwashing and other functions in the restaurant.

The other refrigeration units 22 through 27 are shown in block form, and include double walled condenser coils 46 of size commensurate with the differing capacities of the refrigeration units, and with the coils 46 being located within the heat exchanger 14. A pump 48 is provided to circulate the water through the heat exchanger 14, thereby warming the water within the pre-heat storage tank 16. As hot water is drawn off through the utilization line 52, additional cold water is brought in through line 54 and the water heating cycle continues. It is noted that the size of the hot water heater or boiler 18 may be substantially reduced through the use of the unit 14.

Figure 2:
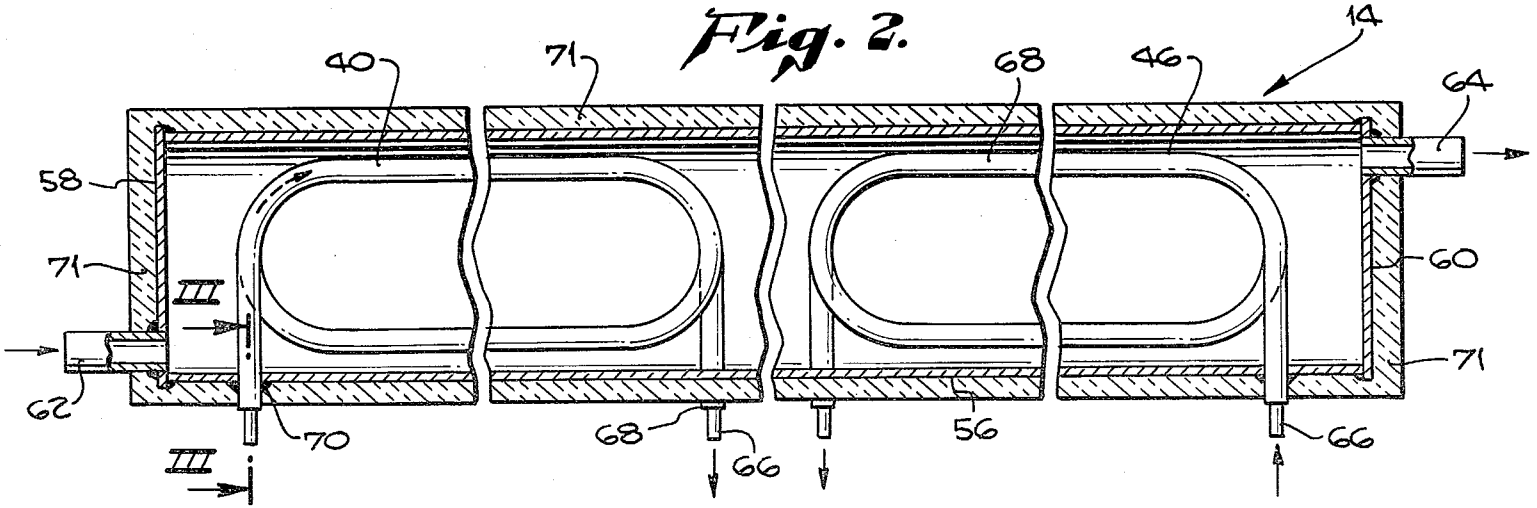
Figure 4:
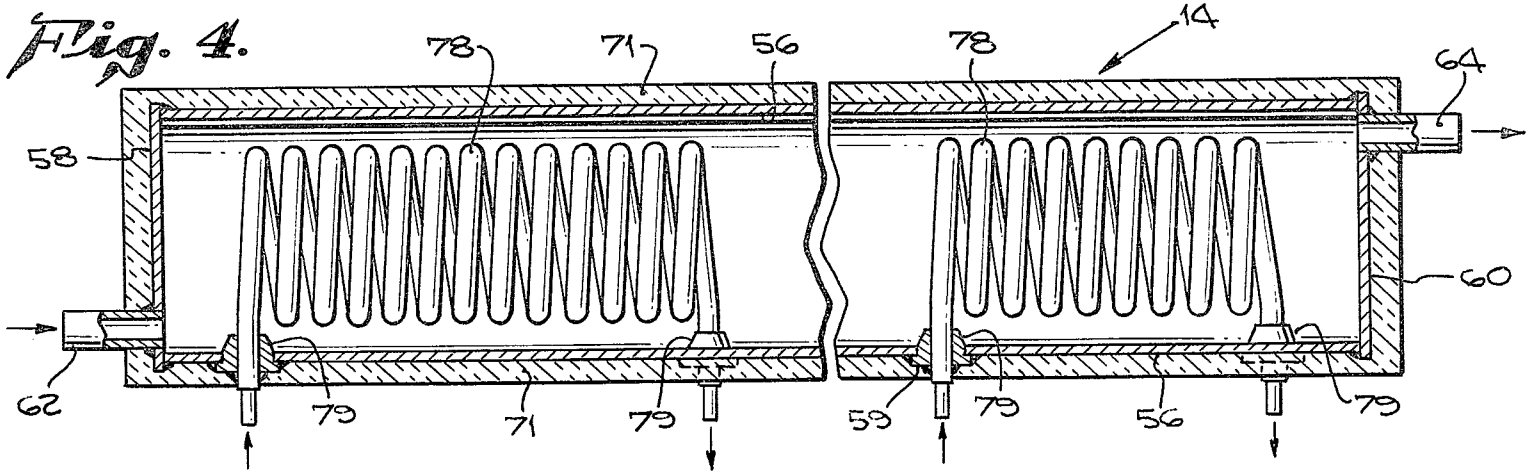

FIGS. 2 through 4 of the drawings show the heat exchanger 14 and the double walled condenser coils 40 and 46 in greater detail.

Specifically, in FIG. 2, the heat exchanger unit 14 may be formed of a standard size cylindrical pipe 56 which would normally range in diameter from about 4 inches to 10 inches or so. Circular end plates 58 and 60 are provided at each end with water inlet fittings 62 and 64 being provided at the bottom and the top, respectively, of end plates 58 and 60. Within the heat exchanger unit 14 are mounted the double walled condenser pipes 40, 46. This piping could, for example, be made of standard $\frac{1}{4}$ inch copper tubing 66 mounted within standard $\frac{3}{8}$ inch copper tubing 68. The outer tubing 68 is soldered to the outer cylindrical wall 56 of the heat exchanger 14 at the area 70 where the tubing 68 passes through the wall of pipe 56. The unit 14 may be provided with exterior insulation 71.

As shown in FIG. 3, the space between the tubes 66 and 68 may be filled with a liquid 72 which is not poisonous and which transfers heat readily from the freon-containing, high pressure tube 66 through the wall of tubing 68 to heat the water within the heat exchanger 14. At the ends of the outer tubing 68, immediately outside the cylindrical wall 56, the two tubes 66 and 68 may be sealed by a suitable low pressure seal, such as a silicon rubber sealant. Although any of a number of low pressure sealing materials may be employed, effective sealing has been accomplished with a General Electric silicone rubber sealant which is widely available, and which is sold under the General Electric Code No. 2567-712. It effectively seals the liquid 72 within the space between tubes 66 and 68 under normal operating conditions, but at high pressures such as one or two atmospheres above normal atmospheric pressure, the sealant 74 will be ruptured and will release the liquid 72 at the end of the outer tubes 68. This action effectively prevents contamination of the potable water within the heat exchanger 14 by the high pressure refrigerant such as freon.

The coils 40 and 46 may be of any suitable configuration for ease in installation within the cylindrical pipe 56 forming the main outer wall of the heat exchanger 14. In FIG. 2, oval or elongated coils having turns which extend along the length of the pipe 56 are shown, while in FIG. 4, double walled coils 78 are shown having their axes aligned with the principal axis of the heat exchanger 14. The remainder of the construction of the unit of FIG. 4 is substantially the same as that of the showings of FIGS. 1 through 3. In each case, the cooling capacities of the coil 40, 46, or 78, are commensurate with the capacities of the corresponding refrigeration units 21 through 27. With regard to the arrangements of FIG. 4, to facilitate assembly of the coil within the pipe 56, the fittings 79 may be employed in oversize holes in the wall unit 56, thereby providing sufficient tolerance to bring the ends of coil 178 out of the heat exchanger and still having an overall diameter of the coils 78 close to the inner diameter of the cylindrical pipe 56.

Instead of the silicone rubber 74 as shown in FIG. 3, one end of the double pipe may be sealed with soft solder, and the second end only may be sealed with a low pressure-releasing seal, such as the silicone rubber.

With regard to certain general considerations, it may be noted that the refrigeration units 21 through 27 as shown in FIG. 1, are often located in a single long rack which may be in the order of 10 to 25 feet in length, for example, in a typical installation in a large restaurant. It may include different refrigeration units for different purposes and might characteristically include one $7\frac{1}{2}$ horsepower (HP) unit, one 5 HP unit, one 3 HP unit, additional units of $1\frac{1}{2}$ HP, and several different fractional HP refrigeration units. In such an installtion, the heat exchange unit 14 might characteristically extend along the length of the refrigeration rack, and have condenser coils 40 and 46 which would be of different sizes, but in each case commensurate with the required cooling capacity of the refrigeration unit. The size of the units 14 might vary in diameter from bout 4 inches up to about 10 inches in diameter, and the length might range from 6 or 10 feet in length up to 20 or 30 feet in length for a large installation. It is interesting to note that there is a considerable capacity for holding hot water within the unit 14. For example, an 8 inch diameter unit which is 9 feet long has a capacity of approximately 21 gallons. In some cases, depending on utilization, a smaller preheat storage tank 16 may be used, or the preheat storage tank may be dispensed with entirely, in view of the capacity of the heat exchanger 14. Also, the large cross-section of the heat exchanger 14 means that there is very low back pressure from one end of the unit 14 to the other, and accordingly, the amount of energy expended in pumping the water through the system is significantly reduced. Further, in view of the single large diameter cylindrical unit 14, the time and labor expense for fitting insulation is greatly reduced as compared with similar heat exchange units where individual assembly and insulation of individual units for each refrigeration system is required. Also, a large number of valves and controls are eliminated by the present arrangements, as compared with prior systems which have been proposed for similar functions.

With regard to the dimensions of the tubing, for relatively small units having a diameter in the order of 4 or 6 inches, the inner tubing might be $\frac{1}{4}$ inch in diameter and the outer tubing of standard $\frac{3}{8}$ inch copper tubing. For larger units with 8 or 10 inch diameter pipe being employed for implementing the heat exchanger 14, the freon tubing could be $\frac{1}{2}$ inch in diameter, and the outer tubing could be $\frac{5}{8}$ inch copper tubing. Incidentally, with regard to the construction of the cylindrical pipe 14, it may be made of copper or preferably of steel, with 12 gauge steel being employed successfully in certain experimental installations.

As mentioned above, in each case, the size of the coils 40 and 46 depends on the capacity and the type of the refrigeration unit with which the condenser coil is associated. In one specific example, for a $3\frac{1}{2}$ HP unit employed for air conditioning, and in which the system operated with a suction temperature of approximately +40 degrees F., approximately 5.2 square feet of area was employed for the condenser coils (using an approximate figure of 8,000 BTU per square foot). Using double walled tubes having $\frac{1}{2}$ inch inner tube and a $\frac{5}{8}$ inch diameter outer tube mounted in an 8 inch diameter heat exchange unit, a total length of tubing within the heat exchanger of approximately 25 to 35 feet was successfully employed.

Incidentally, in refrigeration systems, the freon is normally at pressures of between 100 and 300 pounds per square inch. Accordingly, the low pressure seal 74 for the double wall condenser coil is designed to release at pressures below these levels, for example at pressures such as in the order of 20 to 50 pounds per square inch above atmospheric pressure.

Concerning the potable heat transfer fluid 72 (See FIG. 3), it may be food grade propylene glycol; or preferably may be a silicone heat transfer liquid sold by Dow-Corning under their code number Q-2-1132.

In closing, it is to be understood that the specific arrangements shown and described hereinabove are illustrative of the principles of the invention. Thus, by way of example and not of limitation, the heat exchanger 14 could be rectangular in cross section and formed of sheet metal and could be in two sections instead of in a single unit as shown in FIG. 1; and in some cases could be used for cooling instead of heating. In addition, other non-poisonous heat transfer fluids may be employed in place of those disclosed herein, and other materials may be employed to implement the low pressure seals, instead of the silicone material disclosed above. Also, venting arrangements, extending outside the building in which the installation is housed, may be connected to receive the freon gas when and if the seal 74 (FIG. 3) bursts upon the occurrence of a leak from the high pressure line 66. Accordingly, the present invention is not to be limited to that precisely as disclosed in the foregoing detailed description.

What is claimed is:

1. A unitized multi-unit refrigeration and water heating system in which manifolding of piping is avoided and potable water is protected against contamination, comprising:

an elongated refrigeration installation including a plurality of refrigeration units;

an elongated heat exchanger pipe mounted generally coextensively with said refrigeration installation, said heat exchange pipe having a diameter of at least four inches and a length of at least ten feet;

a plurality of double walled condenser coils formed of standard metal tubing, mounted within said heat exchanger pipe, and having connections extending out from said heat exchanger pipe along the length thereof, said coils having different heat exchange capabilities corresponding respectively to the requirements of the individual refrigeration units in said installation;

non-toxic heat exchange liquid located between the inner and outer tubing of said double walled coils;

low pressure seals located between said inner and outer tubing outside of said heat exchanger pipe;

means for connecting the high pressure refrigeration fluid from individual refrigeration units to corresponding individual ones of said condenser coils; and means for supplying water to be heated to one end of said heat exchanger pipe and for withdrawing heated water from the other end thereof.

2. A system as defined in claim 1 further comprising a preheat storage tank connected to receive heated water from said heat exchanger pipe, and a hot water heater connected to draw water from said preheat tank.

3. A system as defined in claim 1 wherein said refrigeration fluid is supplied to said condenser coils at a pressure above 100 pounds per square inch, and wherein said low pressure seals yield at a pressure below 50 pounds per square inch.

4. A system as defined in claim 1 wherein said heat exchanger pipe is at least 5 inches in diameter and is at least ten times longer than its diameter.

5. A system as defined in claim 1 further comprising a layer of insulation enclosing said heat exchanger pipe.

6. A system as defined in claim 2 further comprising pump means for circulating water between said preheat storage tank and said heat exchanger pipe.

7. A system as defined in claim 1 wherein said heat exchanger pipe is made of steel, and wherein said double-walled condenser coils are made of standard copper tubing of different diameters mounted one within the other.

8. A system as defined in claim 1 wherein the cross-sectional extent of said condenser coils is nearly equal to that of the inner diameter of said heat exchanger pipe, and wherein said condenser coil construction includes means for permitting the resilient deflection of the ends of said coils without significantly deforming the individual turns of said coils, whereby the assembly of said coils through one end of said heat exchanger pipe and the securing and sealing of said coils through the side walls of said heat exchanger pipe, is facilitated.

9. A system as defined in claim 1 wherein said refrigeration installation includes at least four refrigeration units of different cooling capability, coupled respectively to at least four of said condensing coils of corresponding heat dissipation capability.

10. A unitized multi-unit refrigeration and water heating system in which manifolding of piping is avoided and potable water is protected against contamination, comprising:

a refrigeration installation including a plurality of refrigeration units;

an elongated heat exchanger conduit mounted to extend generally along the length of said refrigeration installation;

a plurality of double walled condenser coils formed of standard metal tubing, mounted within said heat exchanger conduit, and having connections extending out from said heat exchanger conduit along the length thereof, said coils having different heat exchange capabilities corresponding respectively to the requirements of the individual refrigeration units in said installation;

non-toxic heat exchange liquid located between the inner and outer tubing of said double walled coils;

low pressure seals located between said inner and outer tubing outside of said heat exchanger conduit;

means for connecting the high pressure refrigeration fluid from individual refrigeration units to corresponding individual ones of said condenser coils; and means for supplying water to be heated to one end of said heat exchanger pipe and for withdrawing heated water from the other end thereof.

11. A system as defined in claim 10 further comprising a preheat storage tank connected to receive heated water from said heat exchanger pipe, and a hot water heater connected to draw water from said preheat tank.

12. A unitized heat exchanger assembly for use with a refrigeration installation including several individual units, said assembly comprising:

an elongated heat exchanger conduit for mounting generally along the length of said refrigeration installation, said heat exchange conduit having a width of at least four inches and a length of at least ten times its width;

a plurality of double walled condenser coils formed of standard metal tubing, mounted within said heat exchanger conduit, and having connections extending out from said heat exchanger conduit along the length thereof, said coils having different heat exchange capabilities corresponding respectively to the requirements of the individual units in said installation;

non-toxic heat exchange liquid located between the inner and outer tubing of said double walled coils;

low pressure seals located between said inner and outer tubing outside of said heat exchanger pipe; and inlet and outlet means located at opposite ends of said heat exchanger conduit.

13. A unitized multi-unit refrigeration and water heating system in which manifolding of piping is avoided, comprising:

an elongated refrigaration installation including a plurality of refrigeration units;

an elongated heat exchanger pipe mounted generally coextensively with said refrigeration installation, said heat exchange pipe having a diameter of at least four inches and a length of at least ten feet;

a plurality of condenser coils formed of standard metal tubing, mounted within said heat exchanger pipe, and having connections extending out from said heat exchanger pipe along the length thereof, said coils having different heat exchange capabilities corresponding respectively to the requirements of the individual refrigeration units in said installation;

means for connecting the high pressure refrigeration fluid from individual refrigeration units to corresponding individual ones of said condenser coils; and means for supplying water to be heated to one end of said heat exchanger pipe and for withdrawing heated water from the other end thereof.

14. A system as defined in claim 13 further comprising a preheat storage tank connected to receive heated water from said heat exchanger pipe, and a hot water heater connected to draw water from said preheat tank.

15. A system as defined in claim 13 wherein said heat exchanger pipe is at least 5 inches in diameter and is at least ten times longer than its diameter.

16. A system as defined in claim 13 further comprising a layer of insulation enclosing said heat exchanger pipe.

* * * * *